US011511391B2

(12) United States Patent
Siebert et al.

(10) Patent No.: US 11,511,391 B2
(45) **Date of Patent: *Nov. 29, 2022**

(54) SURFACE-MACHINING APPLIANCE WITH A SUCTION CONNECTION

(71) Applicant: TTS MICROCELL GMBH, Georgsmarienhutte (DE)

(72) Inventors: Frank Siebert, Bissendorf (DE); Guido Portner, Osnabruck (DE)

(73) Assignee: Festool GmbH, Wendlingen (DE)

( * ) Notice: Subject to any disclaimer, the term of this patent is extended or adjusted under 35 U.S.C. 154(b) by 877 days.

This patent is subject to a terminal disclaimer.

(21) Appl. No.: 16/321,205

(22) PCT Filed: Jul. 21, 2017

(86) PCT No.: PCT/EP2017/068548

§ 371 (c)(1),
(2) Date: Jan. 28, 2019

(87) PCT Pub. No.: WO2018/019737

PCT Pub. Date: Feb. 1, 2018

(65) Prior Publication Data

US 2019/0176293 A1 Jun. 13, 2019

(30) Foreign Application Priority Data

Jul. 29, 2016 (DE) ..... 10 2016 114 099.6

(51) Int. Cl.
*B24B 55/10* (2006.01)
*B24B 23/00* (2006.01)
(Continued)

(52) U.S. Cl.
CPC ..... *B24B 55/10* (2013.01); *B24B 23/00* (2013.01); *B24D 15/02* (2013.01); *B24D 15/04* (2013.01)

(58) Field of Classification Search
CPC ..... B24B 7/182; B24B 23/00; B24B 55/06; B24B 55/10; B24D 15/02; B24D 15/04
(Continued)

(56) References Cited

U.S. PATENT DOCUMENTS 1,844,996 A * 2/1932 Walker ..... B24D 15/023 451/503
2,219,444 A 10/1940 Eserkaln
(Continued)

FOREIGN PATENT DOCUMENTS

DE 2732338 A1 12/1978
DE 19734631 A1 2/1999
WO 02/081148 A1 10/2002

*Primary Examiner* — Eileen P Morgan
(74) *Attorney, Agent, or Firm* — Hoffmann & Baron, LLP

(57) ABSTRACT

A surface processing device, in particular a manual grinding device, includes a processing body which has at least one processing surface for grinding or polishing a workpiece surface, wherein inlet openings are arranged on the at least one processing surface for suctioning off dust-laden dust air and these inlet openings are flow-connected via a duct arrangement to a suction connection to which a suction device can be connected. The surface processing device is provided with an adjustment means for adjustment of effective flow cross-sections, with which inlet openings of a first processing surface section of the at least one processing surface and inlet openings of at least one second processing surface section of the at least one processing surface are flow-connected to the suction connection, so that a suction effect on the first processing surface section and the at least one second processing surface section can be set and/or switched off.

19 Claims, 5 Drawing Sheets

(51) Int. Cl.
*B24D 15/02* (2006.01)
*B24D 15/04* (2006.01)

(58) Field of Classification Search
USPC ..... 451/344, 354, 456
See application file for complete search history.

(56) References Cited

U.S. PATENT DOCUMENTS

| | | | | | |
|---|---|---|---|---|---|
| 4,296,572 | A * | 10/1981 | Quintana | B23Q 11/0046 | 451/356 |
| 4,766,701 | A * | 8/1988 | Roestenberg | B24D 15/023 | 451/344 |
| 6,447,387 | B1 * | 9/2002 | Tseng | B24B 23/03 | 451/359 |
| 6,524,173 | B1 * | 2/2003 | Nelson | A47L 9/02 | 451/178 |
| 6,699,108 | B1 | 3/2004 | Chiang | | |
| 7,033,259 | B1 * | 4/2006 | Seasholtz | B24B 55/10 | 451/354 |
| 2002/0111127 | A1 * | 8/2002 | Tseng | B24B 23/03 | 451/358 |
| 2015/0217427 | A1 * | 8/2015 | Yu | B24B 55/10 | 451/456 |

* cited by examiner

SURFACE-MACHINING APPLIANCE WITH A SUCTION CONNECTION

This application claims priority based on an International Application filed under the Patent Cooperation Treaty, PCT/EP2017/068548, filed Jul. 21, 2017, which claims priority to DE 10 2016 114 099.6, filed Jul. 29, 2016.

BACKGROUND OF THE INVENTION

The invention relates to a surface processing device, in particular a manual grinding device, comprising a processing body which has at least one processing surface for grinding or polishing a workpiece surface, wherein inlet openings for suctioning off dust-laden dust air are arranged on the at least one processing surface, where these inlet openings are flow-connected via a duct arrangement to a suction connection to which a suction device can be connected.

Such a surface processing device is explained in DE 27 32 338 A1, for example. Dust air can be suctioned from at least one processing surface via the suction connection. The known processing device is also suitable for wet applications. However, dust extraction is not optimal for all applications.

SUMMARY OF THE INVENTION

It is therefore the object of the present invention to provide an improved surface processing device with regard to dust extraction.

To achieve the object, a surface processing device of the type mentioned at the beginning is provided with an adjustment device for adjustment effective flow cross-sections, with which inflow openings of a first processing surface section of the at least one processing surface and inflow openings of at least one second processing surface section of the at least one processing surface are flow-connected to the suction connection, so that a suction effect can be set and/or switched off at the first processing surface portion and the at least one second processing surface portion.

Thus, for example, the inflow of external air at a processing surface that is not required or currently not engaged or in contact with the workpiece can be prevented or limited. The suction capacity of the active working surface is therefore higher. Furthermore, a possibly unpleasant air flow during workpiece processing, which would flow over a processing surface that is not in contact with the workpiece, is prevented or reduced.

The first two and at least one second processing surface sections, for example a flat surface section and a curvature section and/or components of a curved portion, may also have mutually angular or curved processing surface sections or processing surface sections. A first processing surface section of at least one processing surface and at least one second processing surface section of at least one processing surface can therefore be understood as a range of processing surfaces.

It is preferably provided that the first and at least one second processing surface section are arranged on mutually angular sides of an outer circumference of the processing body. Processing surfaces which are at an angle to each other or parts of processing surfaces include, or are useful for, processing surfaces in which, for example, one processing surface is a flat surface and the other processing surface proceeds away from the flat processing surface in an arc.

It is also possible that the first and at least one second processing surface section are arranged on opposite sides of the processing body.

In this context, it is only worth mentioning that there may be several processing surfaces or parts of processing surfaces, for example three or four processing surfaces or parts of processing surfaces that are at an angle to each other. In addition, processing surfaces or parts of processing surfaces at angles to each other can also be provided on opposite sides of the processing body.

It is possible that the suction power can be variably adjusted by means of the adjustment device, so that, for example, the suction current flowing over the first processing surface section to the suction connection is smaller or larger than that flowing over at least one second processing surface section to the suction connection.

It is advantageously intended that the adjustment device is designed to reduce the effective cross-section flow between the suction connection and the first processing surface section in favour of increasing the effective cross-section flow between the suction connection and the at least one second processing surface section.

An expedient embodiment has the adjustment means configured to switch a flow connection between the suction connection and the inlet ports of the first processing surface section and the inlet ports of the at least one second processing surface section so that either the inlet ports of the first processing surface section or the inlet ports of the at least one second processing surface section are connected to the suction port. Thus, for example, the suction flow can be switched off at one processing surface while it flows over or through the other processing surface. If several processing surfaces are provided, in particular processing surfaces provided on opposite or angular sides of the processing body, it is possible, for example, to suction one processing surface while the other processing surfaces are switched off, so to speak, with regard to the suction flow. No suction flow then flows to the suction connection via their inlet openings.

Combinations are also readily possible, i.e. the flow connection between the inlet openings of a first processing surface section and the suction connection is switched off or prevented by the adjustment device, while in a second processing surface section there is a full suction flow or a virtually unimpeded flow connection between its inlet openings and the suction connection, and finally in the inlet openings of a third processing surface section there is a lower suction flow compared with the inlet openings of the second processing surface section. This means that the suction capacity is maximal for the second processing surface section, reduced for the third processing surface section and not available for the first processing surface section. This application example is also easily possible for other processing surfaces, for example more than three.

Preferably the processing device has latching means and/or a locking device for latching or locking the adjustment device in at least one adjustment position and/or in all adjustment positions in which the suction connection is flow-connected to only one of the processing surfaces in each case. Thus, for example, the suction power can be switched digitally between the processing surfaces or processing surface sections. The flow connection to the suction connection is always only available for one processing surface section or processing surface. However, latching or locking or a combination of these is also possible in other setting positions, for example as in the above embodiment, in which, for example, not only can a suction flow flow over the inlet openings of a processing surface, but also at least partially or to a reduced extent over the inlet openings of another processing surface.

It should be mentioned that clamping means or similar other fixing means may also be provided for fixing the adjustment device in at least one setting position.

It is expedient that the adjustment device has a manually operable adjustment element, in particular an adjustment ring or an adjustment sleeve, for adjustment the effective flow cross-sections. This means that the adjustment device can be operated manually. However, an electric or other motor drive variant in which, for example, an actuator, in particular an electromagnet, a stepper motor or the like, actuates the setting device would also be easily conceivable.

An advantageous concept provides that the adjustment element is movement-coupled or fixedly connected to a mask body or comprises a mask body, wherein the mask body is disposed between the inflow openings of the processing surface sections and the suction connection and has a passage section with at least one passage opening and at least one reducing section with a closure surface for closing a flow connection between the inflow openings of at least one processing surface portion and the suction connection or being air-permeable with a smaller effective flow cross-section than the passage section. For positioning the passage section or at least one reducing section between the suction connection and the inlet openings of a respective processing surface section, the mask body is mounted movably, in particular rotatably, with respect to the processing body by means of a bearing, in particular a rotary bearing. However, a sliding bearing or a combination of a sliding bearing and rotary bearing would also be easily possible. The at least one reducing section can therefore be completely closed, i.e. a flow connection between the processing surface section or processing surface, to which it is assigned in a respective setting position of the adjustment device, and the suction connection can be prevented. It is also possible that the at least one reducing section reduces a flow connection between the processing surface section or processing surface to which it is currently assigned according to the respective setting position of the adjustment device. The flow cross-section of the reducing section through which the suction flow can flow is smaller than the flow cross-section of the outlet section through which the suction flow can flow.

The mask body can also be referred to as a valve body or be a valve body.

It is also advantageous if the mask body is only permeable to flow at the passage section. In this case the mask body or valve body is closed apart from the diffuser section. This is advantageous, for example, with a digital switchover in such a way that only a first processing surface is suctioned.

It can also be arranged that the mask body forms part of a mask arrangement, the masks of which are adjustable relative to each other, in particular rotatable, in order to adjust an effective flow cross-section for the dust air between the inlet openings of a respective working surface and the suction connection. For example, mask bodies or valve bodies can be provided which are disc-shaped and can be rotated and/or moved relative to each other. It would also be possible to combine drum-like or sleeve-like mask bodies or valve bodies which, for example, are displaceable or rotatable relative to each other or both. By the relative adjustment of the mask bodies or valve bodies it is possible that passage openings or through-flow openings of the two mask bodies or valve bodies are adjustable in different relative positions to each other, in which they are aligned with each other and then provide a maximum flow cross-section or are adjustable or adjusted relative to each other such that, for example, a closed surface or wall surface of one mask body or valve body completely or at least partially covers a passage opening of the other mask body or valve body, so that the flow cross-section of this covered passage opening is closed or reduced.

An advantageous measure provides that at least one suction duct extends along a longitudinal axis of the processing body and said suction duct is flow-connected with the suction connection and with the inflow openings of at least one of the first processing surface sections or the at least one second processing surface section by means of transverse channels or a flow-permeable structure. The air flow can flow from the inlet openings to the suction connection via the so-called elongated suction duct. One or more suction ducts of this type can be provided. It should be understood that all such ducts can extend over the entire length of a processing body. However, it is also possible that one or more suction ducts only extend over part of a longitudinal length of the processing body. A length of a suction duct is preferably designed in such a way that it essentially extends from the respective section of the processing surface to be suctioned to the suction duct.

A suction duct can also serve as a valve body or seat, for example, especially in the embodiment described below.

For example, the at least one suction duct has passage openings which are flow-connected with the inlet openings of the processing surface sections. However, it is also possible that the suction duct has a porous structure or is at least partially permeable to air in some other way, so that air flowing in through the inlet openings can flow into the suction duct.

It is expediently provided that in the at least one suction duct a particularly tubular and/or rod-shaped air guiding body, for example in the form of a mask body or valve body as described above, is mounted so as to be rotatable about an axis of rotation extending along the longitudinal axis and/or displaceable along a sliding axis.

The air guiding body advantageously has at least one through-flow opening on its outer circumference, which is flow-connected with a flow channel which extends along the longitudinal axis and is flow-connected with the suction connection, so that, by adjustment the air guiding body in the suction duct, the at least one through-flow opening of the air guiding body relative to the inflow openings and/or to at least one through-flow opening of the suction duct communicating with the inflow openings of at least one processing surface section can be adjusted in order to change the effective flow cross-section of the inflow openings relative to the suction connection.

The at least one suction duct is, for example, a mask body or valve body which is stationary with respect to the processing body, relative to which the movable mask body or valve body in the form of the air guiding body is movably mounted. For example, both mask bodies or valve bodies are tubular or sleeve-shaped.

It is possible that such air guiding bodies are arranged with separate suction ducts in each suction duct or several suction ducts.

It is preferred that the suction duct comprises a suction duct body in which the air guiding body is mounted rotatably and/or displaceably.

The air guiding body, in particular the mask body or valve body, has advantageously at a first angular segment region or longitudinal region of its outer circumference at least one or at least one through-flow opening, in particular a row arrangement of through-flow openings arranged side by side along the longitudinal axis, and at at least one second angular segment region or longitudinal region no through-flow openings or through-flow openings with a smaller flow cross-section than at the first angular segment region, wherein the through-flow openings are flow-connected with the flow channel which extends along the longitudinal axis and is flow-connected with the suction connection. By rotating and/or displacing the air guiding body, the first angular segment region or the at least one second angular segment region or the first longitudinal region and the first longitudinal region with the inflow openings of the first processing surface portion or the at least one second processing surface portion can be brought into flow connection for adjustment the effective flow cross-section between the suction connection and the respective processing surface by rotating and/or displacing the air guiding body.

A configuration is possible in which the air guiding body is longitudinally displaceably mounted in the suction duct, whereby longitudinal displacement or relative displacement of the air guiding body in the suction duct results in flow openings of the air guiding body communicating with its flow duct with flow openings of the suction duct, which are flow-connected with the inlet openings of a respective working surface or working surface section, can be aligned so that the suction air can flow through the inlet openings of the working surface or working surface section and the through-flow openings of the suction duct into the flow duct of the air guiding body. The through-flow openings of the air guiding body can also be adjusted away from the through-flow openings of the suction duct so that the through-flow openings of the suction duct are at least partially covered and therefore no suction air can flow through the inflow openings of the associated processing surface or processing surface section into the flow duct of the air guiding body.

It is also useful if the air guiding body has sealing contours on its outer circumference which extend in the longitudinal direction and delimit at least one angular segment region, in particular sealing projections or sealing ribs, which bear against an inner circumference of the suction duct. However, a longitudinal area can also be separated from another longitudinal area by at least one sealing contour, whereby the sealing contour then extends in the circumferential direction. Thus, for example, a tubular or sleeve-shaped air guiding body with radially outwardly projecting ribs or sealing contours can be rotatably provided in a suction duct. However, the ribs or sealing contours do not have to lie flatly or sealingly against the inner circumference of the suction duct, but can also be provided with a certain amount of play so that the air guiding body can be rotated or moved more easily.

A suction duct is advantageously provided for each processing surface, which extends along the longitudinal axis of the processing body and is flow-connected to the inlet openings of the respective processing surface. For this purpose, for example, several dedicated suction ducts can be arranged in the processing body as bores, channel bodies or the like. It is also possible, however, that in a single flow body, for example pipe body, angular segments or cross-sectional segments are subdivided, in each of which a suction duct is formed. For example, in such a flow body, which can also be seen in the drawing, partition or interior walls can be provided to separate the suction ducts from each other.

The mask body or valve body is conveniently located between the suction connection and the suction ducts.

The mask body is advantageously mounted for positioning the diffuser section and the at least one reducing section between a respective suction duct and the suction connection, movable by means of the bearing, in particular rotatable and/or displaceable.

Thus it is possible, for example, that the mask or the valve body is arranged between the suction connection and the individual suction ducts, for example on the front side of the suction ducts, and is relatively adjustably mounted for this purpose, for example rotatably mounted and/or displaceably mounted, in order to close a respective suction duct so to speak or to release its flow cross-section. However, it is also easily possible that a respective suction duct is only partially closed, so that its flow cross-section to the suction connection is reduced.

It is advantageously provided that a connecting element of the suction connection for connecting a suction hose is mounted rotatably relative to the processing body, wherein the processing body and the suction hose can be rotated relative to one another advantageously without an adjustment of the adjustment device. The connecting element is usefully tubular or comprises a tube. In this way, a rotary decoupling of the suction hose relative to the processing body is possible, which, among other things, facilitates handling. However, even an unintentional adjustment of the adjustment device, possibly caused by the suction hose, can be easily avoided by a rotary decoupling.

It is expedient that at least one processing surface or part of the processing surface is provided with an inlet channel arrangement open laterally to the processing surface, which is flow-connected to the suction connection by means of at least one of the inlet openings or the inlet openings. In particular, a labyrinth or a tree-like structure of inlet channels or an inlet channel arrangement is provided. The inlet channel arrangement advantageously comprises at least two, preferably several branched, inlet channels which are at least partially open, so that suction air can reach an inlet opening via the inlet channels.

An invention which in itself is independent in connection with the generic concept of claim 1 or also an advantageous design of the previous measures provides that the processing body has a flat surface portion with a flat processing surface for processing flat workpiece surfaces and at least one curved portion with a curved processing surface for processing curved workpiece surfaces.

The flat surface portion and the curved portion each have at least one processing surface section or form one processing surface section.

It is expediently provided that the flat surface portion so to speak provides the first processing surface or processing surface section, wherein the at least one second and preferably third processing surface of the processing surface section is or is provided on the curved portion or sections. Depending on the processing method or the current need for suctioning or the processing surface used, the suction can take place, for example, on the flat surface portion or on the curved portion or on a section of the respective flat surface portion or curved portion.

It is a basic idea that several different radii of curvature and thus several differently designed geometries of the processing surfaces are available for workpiece processing. The continuous course of the curved portion makes it advantageous that no protruding or stepped edges stand in the way of clean and stepless processing of the workpiece surface.

Preferably the curved portion has the course of a spiral or partial spiral.

It is advisable for the curved portion to have the course of a so-called Fibonacci spiral.

However, the curved portion can also have the course of a logarithmic spiral, in particular the course of a so-called golden spiral.

It is conveniently provided that the curved portion is adjacent to transverse end regions of the flat surface portion and extends over a side of the processing body opposite to the flat surface portion, wherein the curved portion has a plurality of continuously merging curvature sections with mutually different radii of curvature and does not project in front of the flat processing surface of the flat surface portion.

It is preferable that the curved portion and the flat surface portion adjoin each other at an angle at at least one transition area. The angular transition area can, for example, provide an edge with which the workpiece surface can be processed. However, the angular transition area can also be an inactive area or an area not intended for processing the workpiece surface, for example an area where the respective end areas or edges of an abrasive are arranged. It is particularly advantageous if the angle is in a range of, for example, 90-45°. The angular transition area can also be designed at an acute angle of 45-25°, for example.

Expediently, provision is made for a large number of radii of curvature. For example, the largest radius of curvature of the curved portion is at least twice, preferably three times, particularly four times as large as the smallest radius of curvature of the curved portion.

It is preferred that a curvature section of the curved portion has a larger radius of curvature at the at least one angular transition area than at least one further curvature section of the curved portion. Particularly preferred, for example, is when a largest or the largest radius of curvature of the curved portion is provided at at least one angular transition area.

It should be understood that an angular transition area can be provided at opposite end areas or transition areas from the flat surface portion to the curved portion. However, an asymmetrical configuration is also possible, for example in connection with the following design.

An advantageous concept provides that the curved portion is tangentially merged into the flat surface portion at exactly one or at least one transition area. The curved portion therefore merges tangentially or continuously into the flat surface portion at one or more transition areas. A rounding or curvature of the curved portion starts directly from the flat surface portion.

It is advantageously provided that a radius of curvature of a curvature section merging tangentially into the flat surface portion is smaller than at least one further radius of curvature of a curvature section of the curved portion, preferably of all further radii of curvature of the other curvature sections of the curved portion. Therefore, a particularly small radius of curvature or the smallest radius of curvature of the curved portion is provided in the tangential transition area between the flat surface portion and the curved portion.

A respective transition area between the curved portion and the flat surface portion is conveniently provided on a longitudinal side area of the processing body.

It is ergonomically favourable and/or in the sense of optimum workpiece processing, for example, if the curved portion protrudes laterally next to the flat surface portion, for example on at least one side or exactly one side of the flat surface portion.

However, it is advantageous if the curved portion does not protrude frontally or in its normal direction in front of the flat surface of the flat surface portion, so that it is completely suitable for flat contact with the workpiece surface without the curved portion being a hindrance.

For example, provision is made such that no polishing agent or abrasive or holding agent for holding an abrasive or polishing agent is arranged on at least one transition area, in particular an angular or the angular transition area between the flat surface portion and the curved portion. As indicated above, the angular transition area can be used to allow an operator to grasp the abrasive or polish particularly easily, for example for a replacement. Furthermore, in some cases it is advantageous that especially in the angular transition area there is no surface suitable for workpiece processing, which could damage the workpiece surface, for example, if the processing device is handled awkwardly.

The following measure provides advantageously that the curved portion and the flat surface portion on opposite sides of the processing body extend essentially over its entire transverse width. This means that particularly large processing areas are available, for example on a top side and a bottom side of the processing device.

It is advantageous, for example, if the flat surface portion extends over part of the cross-section of the processing body and the curved portion over all other areas of the cross-section of the processing body. The surface processing device therefore provides the flat surface portion on the one hand and the curved portion on the other. Of course, it would also be possible to have a configuration in which, for example, side wall sections or side sections are available next to the flat surface portion, which in turn merge into the curved portion. This makes it possible, for example, to produce a processing body that is basically cuboid in shape but has a curved portion.

A preferred concept is for the curved portion to be connected to opposite transverse end areas of the flat surface portion. Thus, a transition to the curved portion, for example the above-mentioned angular transition area and/or the above-mentioned tangential transition area, is provided at both transverse end areas or side areas of the flat surface portion.

It is expediently planned that the processing body is designed wholly or at least in sections as a cylinder and/or as a cone, on the circumferential surface of which the curved portion and the flat surface portion are provided. The cylindrical design has the advantage that the processing body has a continuous shape over a longitudinal length or along a longitudinal axis, i.e. large processing surfaces with the same contours over the longitudinal length or longitudinal axis are available for workpiece processing. A cone has the advantage that, for example, the radii of curvature of the curved portion at one longitudinal end of the cylinder are larger than at the other longitudinal end. This provides additional and narrower radii of curvature. It should be understood, for example, that a conical section can be provided on a cylindrical section of the processing body.

It is also possible to design the at least partially or sectionally conical and/or partially or sectionally cylindrical processing body in steps:

Preferably it is intended that the processing body has at least one step or is designed as a step body. For example, several, for example at least two, cylindrical sections may be arranged side by side with respect to a longitudinal axis of the processing body. These cylindrical sections or a cylindrical section can also be followed by a conical section, for example.

At this point it should be mentioned that the processing body preferably has the outer contour or shell contour according to the invention over its entire length. It is also possible, however, that the processing body has the flat surface portion and curved portion described above over one section, while another section, for example, is cuboidal or circular cylindrical or is arranged with another circumferential geometry or geometry of processing surfaces.

An advantageous concept envisages that the processing body in the area of the curved portion has the profile of the upper side of a wing, on the underside of which the flat surface portion is arranged. The upper profile thus has a curvature that runs in an arc on one side towards the flat surface portion, but in the opposite direction runs out at an angle and flat.

It is preferable if a length of the processing body is greater than a transverse width and/or a transverse height of the processing body, whereby the curved portion and the flat surface portion extend over the respective length of the processing body. The processing body therefore has an elongated shape.

It is also useful if a transverse width of the flat surface portion is greater than a height of the processing body, so that the processing body has a flat shape.

It is useful if the processing body is elastic. It preferably includes or is made of a foam material. It is also possible that that the processing body may have a relatively hard core, for example by placing an air-guiding body or air baffle there which acts as a stiffener. On the relatively hard core, the elastic and/or foam material can be arranged, so that in any case the preferred design is achieved, which looks as follows. A foam material or an elastic, yielding material is preferred at least in the area of the at least one working surface. The foam material contains or is preferably polyurethane foam.

The surface processing device shall be provided with an abrasive and/or polishing agent on the flat processing surface and/or curved portion as appropriate.

A polish or abrasive may, for example, be or comprise a grain or grain structure. However, the polishing agent or abrasive may also be or comprise a knitted fabric, e.g. an abrasive knitted fabric, or an abrasive cloth or polishing cloth.

It is possible that different abrasives or polishes are arranged in different zones of the working surface, for example the curved working surface and the flat working surface. For example, it is conceivable that the curved portion may have an abrasive and the flat surface portion a polishing agent. However, it is also possible that the curved portion has two different abrasives or polishing agents. It is also possible for the flat surface portion to have not only one abrasive or polishing agent, but at least two different abrasives, e.g. abrasives with different grain sizes, different grain materials or the like, or at least two different polishing agents, e.g. differently hard and/or dense polishing cloths.

It is possible that the processing body has integral abrasives or polishing agents, i.e. an abrasive grain, an abrasive knitted fabric, a polishing cloth or other polishing material or the like is arranged in the area of at least one processing surface, for example. The processing body will be replaced when worn out.

The following measure is advantageous in terms of favourable consumption or sustainability: It is useful if holding means, such as an adhesive layer, a hook-and-loop layer or the like, are provided on the outer circumference of the processing body or at least one processing surface in order to hold an abrasive or polishing medium, such as an abrasive sheet, an abrasive knitted fabric or the like.

It is useful if the abrasive or polishing agent which can be or is detachably or firmly arranged on the processing body by means of the holding means has a blade-like shape. In particular, the abrasive or polishing agent is an abrasive paper or polishing paper.

An abrasive or polishing agent releasably attachable to or disposed on the working body is expediently a component of a system comprising the processing body and the abrasive and/or polishing agent.

It is preferable if the flat surface portion and/or the curved portion present an uninterrupted or continuous abrasive and/or polishing agent. It is also advantageous for the flat surface portion and/or the curved portion if it has continuous holding means, in particular a hook-and-loop layer, for holding an abrasive or polishing agent. For example, there is no section on the flat surface portion or the curved portion that does not contain any abrasive or polishing agent.

In particular, transitions between sections or end regions of the polishing agent or abrasive, whether directly arranged integrally on the processing body or designed as exchangeable components, are only provided at a transition region between the flat surface portion and the curved portion. For example, no edge of an abrasive sheet is arranged on the flat surface portion or the curved portion.

The concept explained here is preferably used with a manual surface processing device. However, it is also possible that an automatic surface processing device is designed according to the invention. For example, a drive, in particular an electric or pneumatic drive motor with a corresponding transmission gear, may be provided for driving the processing body to rotatory and/or eccentric and/or hypercycloid and/or oscillating movements. For example, the drive is arranged in a machine housing on which the processing body is arranged.

Regarding the manual processing device, it is advantageous if, for example, it has a handle on which the processing body is arranged. The handle is preferably arranged on a suction connection or has a suction connection for extracting dust from at least one working surface.

BRIEF DESCRIPTION OF THE DRAWINGS

Embodiments of the invention are explained below using the drawing. This shows.

DETAILED DESCRIPTION

Figure 1:
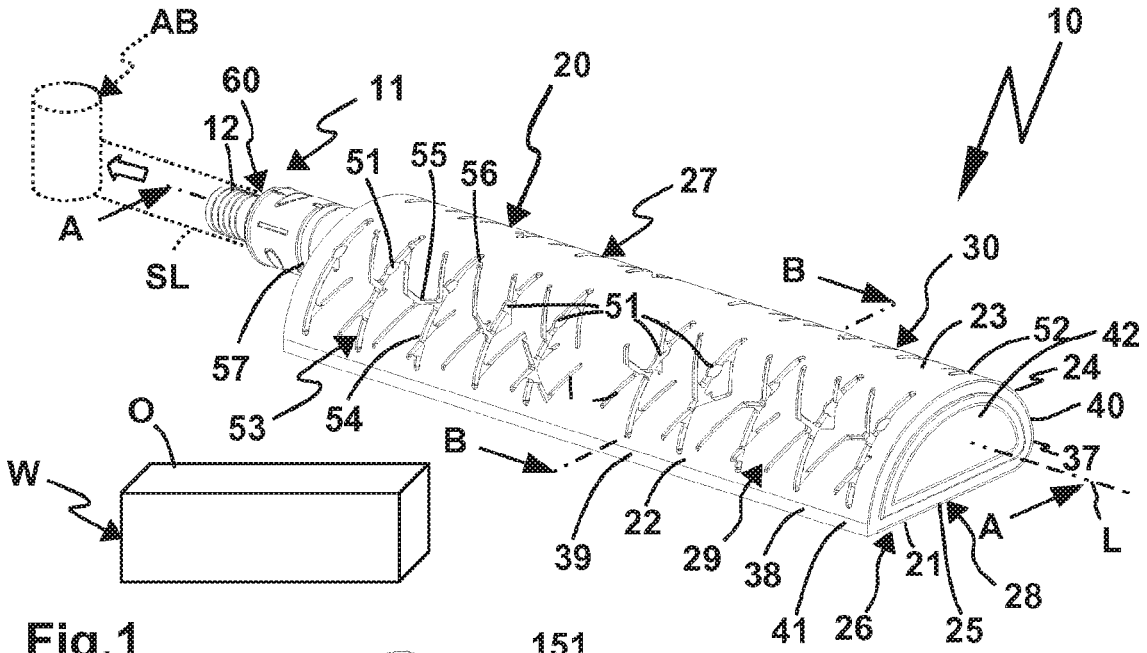
FIG. 1 a perspective oblique view of a surface processing device.

A processing device 10 comprises a processing body 20, the outer circumference of which is provided with several processing surfaces 21, 22 and 23. By means of the processing surfaces 21-23, a schematically indicated workpiece W can be processed on its workpiece surface O, e.g. ground and/or polished. The processing surfaces 21-23 extend on an outer circumference 24 of the cylindrical processing body 20. The processing body 20 has a longitudinal shape and extends along a longitudinal direction or longitudinal axis L.

The processing surface 21 is equipped as a flat surface 25 or flat surface with which a correspondingly flat workpiece surface O can be optimally processed. The processing surface 21 or flat surface 25 is provided on a processing surface section 28, which is designed as a flat surface portion 26 on the basis of the flat surface 25.

The processing surfaces 22 and 23, on the other hand, are curved processing surfaces and are provided on processing surface sections 29, 30, which form part of a curved portion 27.

The processing surfaces 21-23 merge into each other continuously, so that they can also be described as a single processing surface. The distinction between processing surfaces 21-23 is intended in particular to clarify the assignment to the processing surface sections 28-30.

In any case, the curved processing surfaces 22-23 in principle form a single processing surface, which, however, has different radii of curvature and thus different geometric properties, as will become clear below.

The curved portion 27 has several continuously merging curvature sections 31, 32, 33, 34, 35, 36 with different radii of curvature, for example R1, R2, R3, R4, R5. The curvature sections 31-36 merge continuously into each other, which means that ultimately there are also other radii of curvature which are not named in detail here. It is possible, for example, that the curved portion 27, starting from the radius of curvature R1, has a large number of radii of curvature not explained in detail up to the radius of curvature R5.

Figure 4:
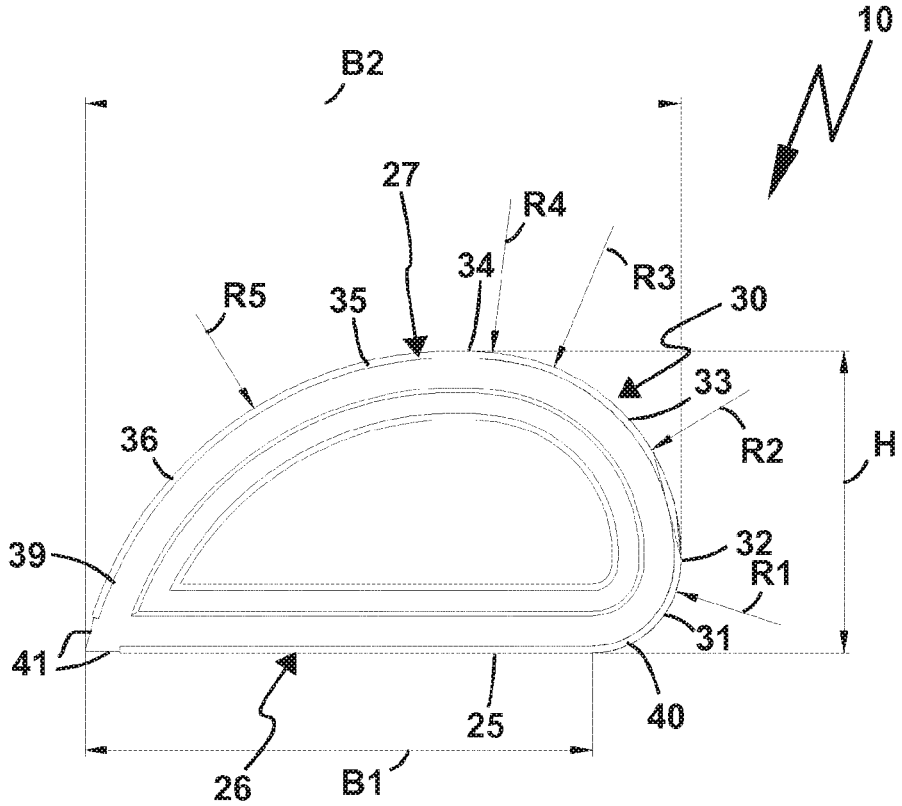
FIG. 4 a frontal view of a processing body of the processing device according to the figures above in order to illustrate its outer peripheral contour, which is shown in a FIG. 5 a cross-section along a section line A-A in FIG. 1.
Figure 5:
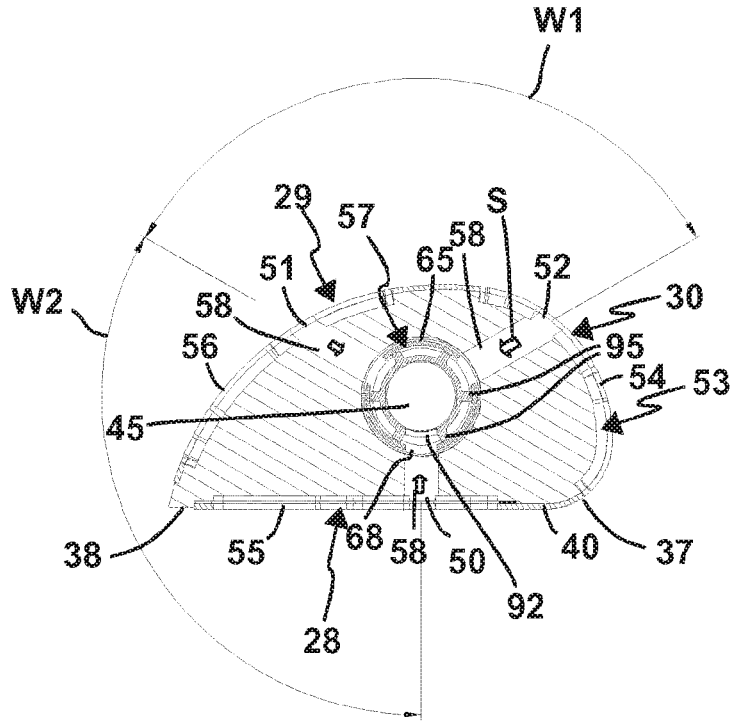
Figure 6:
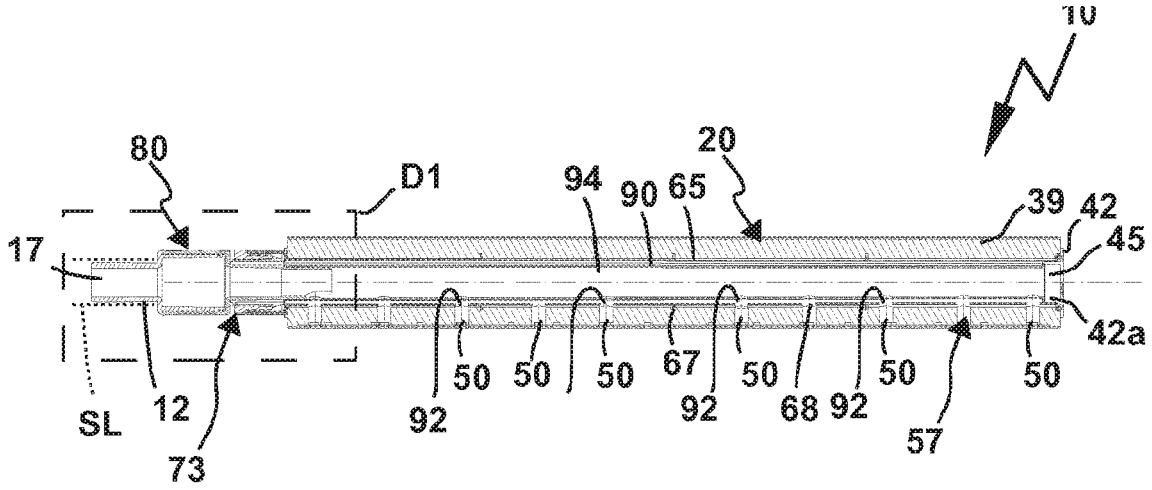
FIG. 6 a longitudinal section through the processing device according to FIG. 1, along a cutting line A-A in FIG. 1.
Figure 7:
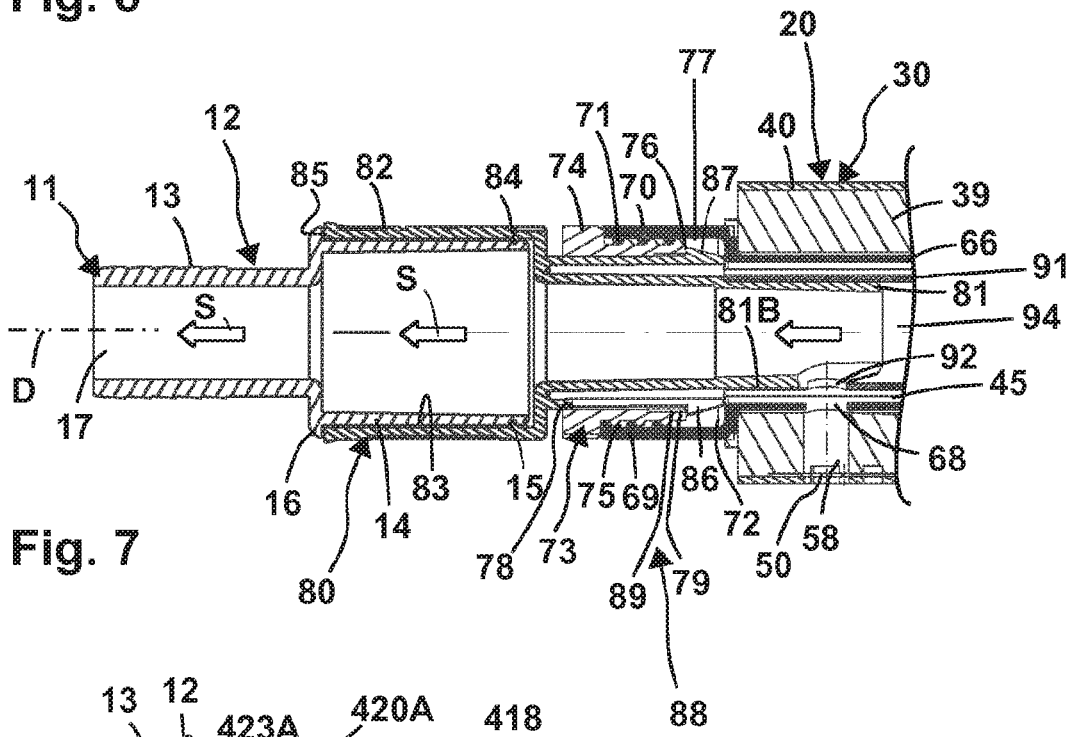
FIG. 7 a detail D1 from FIG. 6.

At a transition area 37 shown in FIGS. 4 and 5 on the right, the flat surface portion 26 merges tangentially into the curved portion 27. The smallest radius of curvature R1 is present there. The curved portion 27 projects laterally into the transition area 37 in front of the flat surface portion 26. However, the curved portion 27 does not project in front of the flat surface 25 frontally and or in its normal direction. A flat engagement of the flat surface 25 with the workpiece surface O is therefore possible without being affected by the curved portion 27. However, the narrow radius of curvature R1 allows the processing of correspondingly curved or narrow parts of the workpiece surface O.

In contrast to radius R1, radius R5 is significantly larger, for example at least twice as large or three times as large, preferably about four times as large as radius R1, so that the curved portion 27 ends relatively flat towards a transition area 38, where the curved portion 27 angularly adjoins the flat surface portion 26, for example with an angle of less than 90°, preferably 80-70°. Transition area 38 and transition area 37 are provided on opposite sides of the flat surface portion 26 and extend along the longitudinal axis L.

Overall, the processing body 20 has a cylindrical, wing-like shape, whereby the underside of the "wing", unlike a real wing, is flat or even, i.e. has no concave or convex curvatures. The upper side of this wing extends in a convex manner over the flat surface 25 and is round at the transition area 37, while in the transition area 38 it ends at an angle to the flat surface 25.

A transverse width B1 of the flat surface 25 or the flat surface portion 26 is almost as large as a transverse width B2 of the curved portion 27, such that the surface of the curved portion 27 and the flat surface 25 that can effectively be used for workpiece processing is similarly large.

However, the usable surface area of the curved portion 27 is larger insofar as the transverse width B2 is larger than the transverse width B1 and the curved portion 27 also extends in a convex manner over the flat surface portion 26, or curves, so to speak. The processing body 20 has a height H over which the curved portion 27 curves over the flat surface portion 26.

It is expedient that the height H is about half as large as the transverse width B1 or B2.

This results in a compact, handy and therefore manually conveniently grippable processing body 20.

In this embodiment, the angular transition range 38 is not intended for workpiece processing. In principle, however, this would be readily possible, for example if an appropriate polishing agent or abrasive is available.

In the present embodiment, however, it is provided that a base material or base material 39 of processing body 20 is exposed in the transition area 38, i.e. no polishing agent or abrasive is provided and also no adhesive or holding means 40 is provided, which otherwise extends over the outer circumference 24 of processing body 20. The base material 39, for example, is a polyurethane foam or other elastic material. Adhesive or holding means 40 includes, for example, an adhesive layer, an adhesive layer or the like.

The transition area 38 without holding means 40 has a grip zone or grip areas 41 at which an abrasive 120 in the form of an abrasive sheet described below can be conveniently grasped and thus removed from the processing body 20.

The relatively soft processing body 20 is covered by covers 42, 43 at its end faces, the cylinder base surfaces so to speak, and thus protected. The covers 42, 43 are preferably harder than the base material 39, e.g. made of a thermoplastic material. Covers 42, 43 include or are designed as cover plates, for example. Covers 42, 43 may be bonded to the foam material of the processing body 20.

The abrasive 120 has holding means 140, for example a Velcro layer or hook, which work together with the holding means 40 of the processing body 20 in the sense of a fixed neck suitable for surface processing of the workpiece W. In other words, the abrasive 120 can be detachably attached to the outer circumference 24 of processing body 20 by means of holding means 140, 40. This is known per se. An abrasive material 124, for example a knitted abrasive material, a grain or the like, is provided on a side of the abrasive 120 opposite to the side of the holding means 140 with which the workpiece surface O can be treated in the sense of abrasive processing or grinding.

Alternatively, it would of course also be possible for an abrasive, polishing agent or the like to be arranged directly on the outer circumference 24 of the processing body 20, for example the abrasive material 124.

Figure 2:
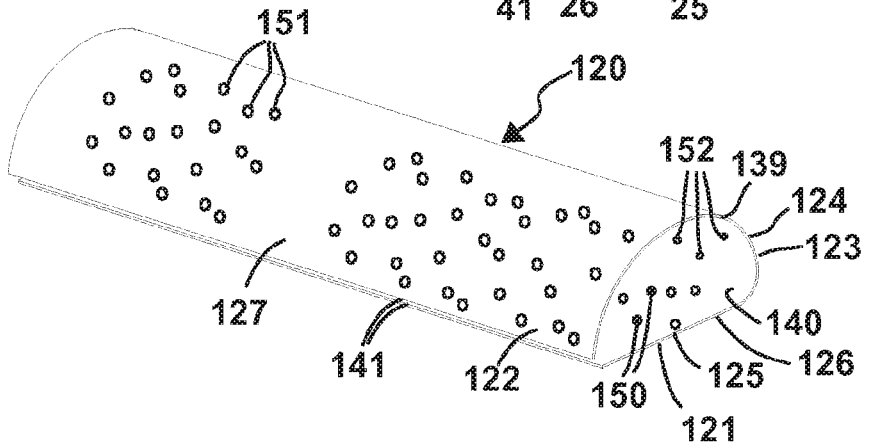
FIG. 2 a perspective oblique view of an abrasive for the processing device according to FIG. 1.
Figure 3:
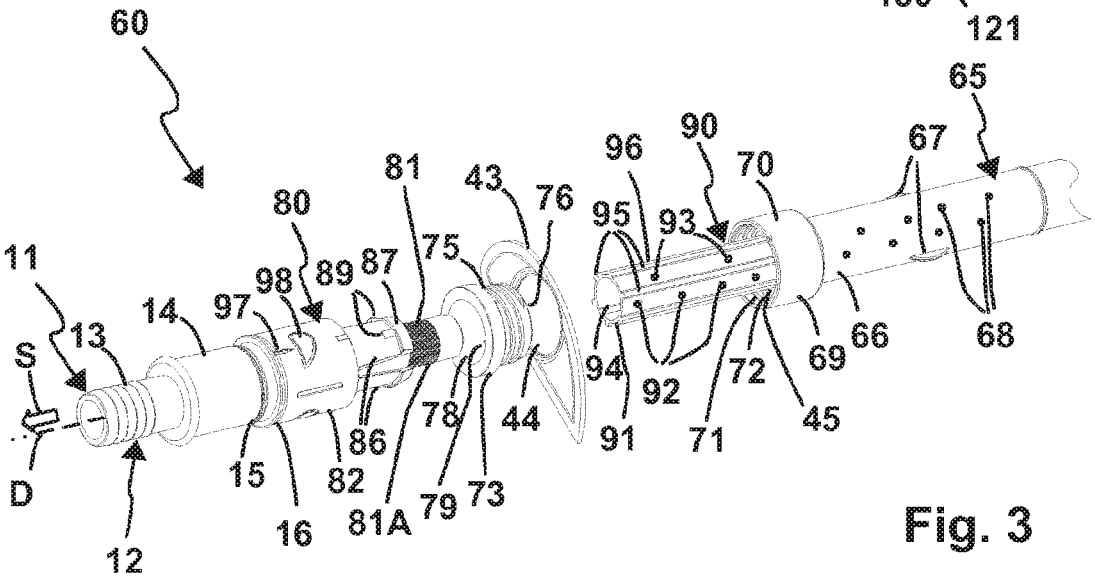
FIG. 3 an exploded view of an adjustment device for adjustment a suction effect on the processing device according to the diagrams above.

When the abrasive 120 is placed on the processing body 20 (not shown), it assumes the shape of the outer periphery 24 of the processing body 20 schematically indicated in FIG. 2. Thus, the abrasive 120 has a processing surface 121 and processing surfaces 122, 123 which are adjacent to the processing surfaces 21, 22, 23 of processing body 20. The processing surface 121 forms a flat surface 125 and thus a flat surface section 126, while the other processing surfaces 122, 123 form components of a curved portion 127, corresponding to the curved portion 27 of the processing body 20.

The abrasive 120 has side edges 141, which are positioned in the handle areas 41 when the abrasive is in the state 20 arranged on the processing body. The abrasive 120 can be gripped comfortably there and removed from the processing body 20, so to speak, whereby the holding means 40, 140 disengage from each other.

Furthermore, inlet openings 150, 151, 152 are provided at the processing surfaces 121, 122, 123 through which dust which is formed, for example, during an abrasive processing of the workpiece surface O using the grinding material 124, can be suctioned off.

The inlet openings 150-152, for example, are made in the form of holes, projections or the like.

When the abrasive 120 is mounted or arranged on the processing body 20, the inlet openings 150-152 communicate with the inlet openings 50, 51 and 52 on the processing surfaces 21, 22, 23, i.e. with the inlet openings 50, 51 and 52 provided on the processing surface sections 28-30.

The inlet openings 50, 51, 52, for example, have angular distances with angles W1 and W2 which are preferably equal. These allow dust to be extracted from the sides of the processing body 20 that are at an angle to each other, i.e. with angular distances W1 and W2.

The inlet openings 50, 51, 52 are flow-connected with an inlet channel arrangement 53, the inlet channels 54, 55, 56 of which are open to the respective processing surface 21, 22, 23. The inlet channels 54-56 are mentioned as examples and represent a large number of inlet channels branching away from the inlet openings 50-52. One or more of the inlet openings 150-152 of the abrasive 120 are arranged above a respective inlet channel 54-56 so that dust-laden air can flow through the respective inlet opening 150-152 into the inlet channels 54-56 and from there further into the inlet openings 50, 51 and 52. This means that an inlet opening 50-52 is not provided for each of the inlet openings 150-152. Instead, dust air can flow through several inlet openings 150-152 and via the inlet channels 54-56 to the inlet openings 50-52. Furthermore it is possible that an inlet channel 54, 55 or 56 communicates or is flow-connected with several of the inlet openings 50 or 51 or 52, which is indicated by the example of the flow channel 55 in FIG. 1. In any case, it is ensured that a dust extraction system is provided under a large number of inlet openings 150-152 of the 120 abrasive.

When using the processing device 10, the processing body 20 is usually only partially in contact with the workpiece W. For example, only one of the processing sections 28, 29 or 30 is effectively used, while the other processing sections are not used. The operator will select the processing section 28, 29, 30 that is best adapted to the surface geometry of the workpiece surface O or which allows optimum grinding or polishing. The problem here is that dust extraction would not only take place at the processing lot 28, 29, 30 used in each case, but also air would flow over the unused processing section 28 or 29 or 30, i.e. false air would flow, so to speak. The measures described below effectively remedy this situation:

The dust extraction can be effectively adjusted by means of an adjustment device 60, 260, 360. The adjustment device 60 is provided for the processing device 10 according to FIGS. 1-7, the adjustment device 260 for a processing device 210 according to FIGS. 8-12 and the adjustment device 360 for a processing device 310 according to FIGS. 13, 14 and 15. The processing devices 210, 310 have processing bodies 220, 320, which are constructed in the same way with regard to their basic external design, for example the external circumference 24, the processing surface sections 28-30 and the like, and are therefore not explained in detail in this respect. However: the flow concept and its adjustment for the suction flow are designed differently. The adjustment devices 60, 260, 360 make it possible to switch the suction between the inlet openings 50, 51 and 52 and in advantageous embodiment to influence the suction capacity or the effective flow cross-section for the suction provided for the inlet openings 50, 51 and 52.

The inlet openings 50, 51 and 52 are flow-connected via a duct arrangement 57 and the adjustment devices 60, 260, 360 with a suction connection 11. The suction connection 11, for example, comprises a connection element 12, especially in the form of a connection pipe to which a suction hose SL can be connected, which leads to a suction device AB. The suction device AB includes, for example, a mobile vacuum cleaner or a stationary central vacuum cleaning system.

At this point it should be mentioned that, according to the invention, a processing device can of course also be equipped with a dust extraction system on board the processing device. For example, it is possible to connect a dust collection container to suction connection 11. Preferably, a fan or other flow generator for generating a suction flow, which can flow through the inlet openings, which are assigned to the processing surfaces, in particular to a respective processing surface section, therefore in the embodiment the inlet openings 50 or 51 or 52, is then assigned to this or connected upstream.

The connection element 12, for example, comprises a connection section 13 for plugging on or plugging in the suction tube SL. A ribbing is preferably provided at connection section 13. The connection element 13 also has a connection section 14 which is intended for rotatable connection with the components of the adjustment device 60 explained below.

The duct arrangement 57 comprises transverse ducts 58, which lead inwards from the inlet openings 50, 51, 52 in the processing body 20, 220, 320 and open out into a central suction duct 45 via passage openings 68 in the processing body 20, into separate suction ducts 245, 246, 247 in the processing body 220 and into separate suction ducts 345, 346, 347 in the processing body 320.

The suction ducts 45, 245, 246, 247 and 345, 346, 347 extend along the longitudinal axis L of the processing body 20, 220, 320, preferably over the entire or almost entire longitudinal length of the processing body 20, 220, 320. They are closed at the front by covers 42, for example, whereby another closure would also be possible.

Suction duct 45 is provided in a suction duct body 65, which has a tubular shape. The suction duct body, for example, has a circumferential wall 66, which is designed as a tube. The circumferential wall 66 or the suction duct body 65 is equipped with ribs 67, which improve the hold in the base material 39 of the processing body 20. For example, the suction duct body 65 is surrounded by the base material 39. On the front side, the suction duct body 65 can be closed by the cover 42, but also by a base that is integrally formed on the suction duct body 45. The cover 42, for example, has a closing projection 42*a* which can be inserted into the suction duct body 65 or a cavity of the processing body 20 which has the suction duct body 65.

Openings 68 are also provided on the circumferential wall 66, which are flow-connected to the transverse ducts 58, in particular for alignment. Thus, dust air can flow through the inlet openings 50-52 and the transverse ducts 58 as well as finally the passage openings 68 in order to reach the suction duct 45.

On the side facing the suction connection 11, the suction duct body 65 has a connection section 69, for example a connection sleeve 70. At the connection section 69, which is connected to the peripheral wall 66 or represents an extension thereof, a screw thread 71, in particular an internal thread, is preferably provided. Alternatively, a contact surface could also be provided for bonding or latching or the like.

In the suction duct body 65, the suction duct 45 extends and discharges from the suction duct body 65 at the connection section 69.

A connection element 73 is connected to the connection section 69, for example screwed in. The connection element 73, for example, comprises a tubular or sleeve-shaped connection body 74, which has a screw thread 75 at a connection section. The screw thread 75 is screwed into the screw thread 71 of the suction duct body 65 to create an essentially airtight connection.

The connecting body 74, for example, penetrates an opening 44 in the cover 42.

An intermediate space 77 is provided between an end face 76 of the connecting body 74 and the bottom of a receptacle 72 of the connecting section 69, in which the screw thread 71 is arranged.

The connecting element 73 has a bearing receptacle 78 in which an adjustment element 80 engages and in which the adjustment element 80 is rotatably mounted. One axis of rotation D of the adjustment element 80 in relation to the bearing support 78 corresponds to the longitudinal axis L, for example. The connection element 73 and the adjustment element 80 together form bearing elements of a rotary bearing.

The adjustment element 80 has a duct body 81 which projects from an adjustment section 82 of the adjustment element 80 towards the suction duct body 65. The adjustment section 82, for example, has a receptacle 83 in which the connecting element 12 engages with the connecting section 14. The receptacle 83 forms a pivot-bearing receptacle in which the connecting section 14 is rotatably mounted so that a rotary decoupling is created between the connecting element 12 or the suction connection 11 on the one hand and the processing body 20 and/or the adjustment device 60.

A retaining projection 84 is preferably located in receptacle 83, for example an annular or part-annular rib arranged on the inner circumference of receptacle 83 and projecting radially inwards, which engages in a corresponding recess 15 on the connecting section 14 of connecting element 12. By means of the retaining projection 84 and the recess 15, the connecting element 12 is fixed in a tension-resistant manner with respect to its axis of rotation around which it can rotate relative to the receptacle 83. The axis of rotation corresponds to the longitudinal axis L or is parallel to the longitudinal axis L.

It is expedient for the mounting element 12 with a flange projection 16 to be in contact with a face 85 of the adjustment element 80. It is also advantageous if one end face of the connection element 12 or the connection section 14 is supported at the bottom of the slot 83.

Due to the rotary bearing of the connection element 12 on the one hand on the adjustment element 80 and on the other hand on the adjustment element 80 with respect to the processing body 20 or the connection element 73, the adjustment element 80 can rotate freely between the suction hose SL and the processing body 20.

The adjustment element 80 is held on the connection element 73 in a tension-resistant position relative to the longitudinal axis L or its axis of rotation D relative to the connection element 73 by means of a catch. For example, hook projections 86 are provided on the adjustment element, which protrude in front of adjustment section 82. The hook projections 86 have hook lugs 87, which engage in the gap 77, so that the adjustment element 80 on the connecting element 73 is fixed in a tension-resistant manner with respect to the longitudinal axis L of the axis of rotation D with respect to the connecting element 73. The hook projections 86 are spaced from each other in the circumferential direction so that they can be moved radially to lock into the bearing seat 78. Thus the adjustment element 80 can be inserted and locked into the bearing seat 78 along the longitudinal axis L or the rotational axis D. Assembly is simple.

Fixing means 88 are preferred, in particular a locking device or locking means. Fixing means 88 include, for example, locking lugs 89, which project radially outwards in front of the hook projections 86 and engage in corresponding locking recesses 79 of the connection element 73. For example, the locking recesses 79 are provided on an inner circumference of the bearing receptacle 78.

An air guiding body 90 is non-rotatably connected to adjustment element 80, in particular duct body 81. For example, the duct body 81 is inserted into the air guiding body 90 and in the area of a connecting section 81A it is glued, latched, pressed or similarly firmly connected in some other way. If the adjustment element 80 is turned around the axis of rotation D, the air guiding body 90 rotates accordingly.

A combination of a groove and a projection projecting into the groove or similar other mechanical 81B angle of rotation marking, which is provided for example between the duct body 81 and the inner circumference or flow duct 94 of the air duct body 90, is useful for the correct angle of rotation assembly of the adjustment element 80 and the air duct body 90.

The air guiding body 90 has a cylindrical or tubular shape and extends along the longitudinal axis L in the suction duct 45. The air guiding body 90 is rotatably mounted in the suction duct 45. The air guiding body 90 has a circumferential wall 91 on which through-flow openings 92, 93 are provided through which air can flow into an interior space of the air guiding body 90, namely into a flow channel 94. The outer circumference of the air guiding body 90 is provided with sealing contours 95, e.g. longitudinal ribs, which lie against the inner circumference of the suction duct 45 or at least are arranged close to this inner circumference. The sealing contours 95 separate the angular segments of the air guiding body 90 from each other, so to speak. One of the angular segments, for example, comprises the flow-through openings 92, another angular segment the flow-through openings 93. The other angular segments, which are separated from each other by the sealing contours 95, have no through-flow openings and are therefore flow-tight.

By rotating the air guiding body 90 in the suction duct 45 about the axis of rotation D, the flow openings 92 can be positioned opposite the flow openings 68 assigned to the inlet openings 50 or 51 or 52, so that dust air S can pass through the respective inlet openings 50 or 51 or 52, the cross channels 58 and the flow openings 92 can flow into the flow channel 94 and flow further via the adjustment element 80 to the suction connection 11, where the dust air S can flow from a flow channel 17 of the connecting element 12 into the suction hose SL. A flow cross-section of this flow connection is thereby maximum.

The air guiding body 90 thus forms a valve body or mask body 96, on whose rotary position in relation to the rotary axis D the flow cross-section depends, which is available for the respective inlet openings 50, 51 or 52 for extraction via the suction connection 11.

A respective rotational position of the air guiding body 90 or the adjustment body 80 can be traced by means of at least one index 97, which is arranged, for example, on the outer circumference of the sleeve-shaped adjustment body 80. Also advantageous are symbols 98 for the respective processing surface sections 28, 29, 30 arranged on the adjustment body 80, especially close to the index or the indices 97. Thus, the operator can easily recognize which processing surface sections 28, 29, 30 are currently being suctioned off in the respective rotary position of the adjustment body 80 and the air guiding body 90, e.g. if only the flow openings 92 are present.

The through-flow openings 93, on the other hand, are an option. The number or effective flow cross-section of the flow openings 93 is smaller than the number or effective cross-section of the flow openings 92. If the through-flow openings 93 are opposite the through-flow openings 68, suction is still possible via the inlet openings 50 or 51 or 52 assigned to the through-flow openings 68, but with a lower suction power or suction effect compared to suction via the through-flow openings 92.

An embodiment is also possible in which the flow openings 92 or the flow openings 93, for example, or a combination of both, i.e. both the flow openings 92 and the flow openings 93, are positioned opposite the flow openings 68 assigned to a respective processing surface section 28, 29, 30. This means that the suction capacity can be changed in a total of 4 stages for each processing area 28, 29, 30: no flow, greater flow via the flow-through openings 93, even greater flow via the flow-through openings 92 and maximum flow via the combination of the flow-through openings 92 and 93.

With the adjustment device 260 shown in FIGS. 8-11, an adjustment mimic arranged at the front in the vicinity of the suction connection 11 ensures that the dust air can flow through one of the 245, 246 or 247 suction ducts or that the flow cross-section of these 245, 246 or 247 suction ducts is released or closed. A mask body 296 of the adjustment device 260 is arranged between the suction connection 11 and the end face or on the end face of the processing body 220.

The suction ducts 245, 246 or 247 run in a suction duct body 265 which extends along the longitudinal axis L in the processing body 220. The suction duct body 265 has a peripheral wall 266 which delimits a tubular interior in which partition walls 267 extending along the longitudinal axis and connected to each other, approximately in the centre of the suction duct body 265, are arranged. The partition walls 267, for example, are arranged in a star shape and separate the interior of the suction duct body 265, which is limited by the circumferential wall 266, into the suction ducts 245, 246 or 247. On the circumferential wall 266, passage openings 268 communicating with the suction ducts 245, 246 or 247 are provided, which are flow-connected with transverse ducts 58, which in turn communicate with the inlet openings 50, 51, 52 and thus with the processing surface sections 28, 29, 30. This means that each processing surface section 28, 29, 30 is assigned to one of the suction ducts 245, 246 or 247.

On the basis of an adjustment element 280 of the adjustment device 260, one of the suction ducts 245, 246 or 247 can each be flow-connected to the suction connection 11, so that as a result one of the working surface sections 28, 29 or 30 is flow-connected to the suction connection 11 and a removal by suction for the respective processing surface section 28, 29 or 30 is available. The adjustment element 280 forms or includes the mask body 296.

The adjustment element 280 rotates to accommodate the connection element 12 already described. For example, the adjustment element has a receptacle 283 in which the connection section 14 is rotatably mounted. A retaining projection 284, for example an annular retaining projection 284, arranged on the receptacle 283 engages in its recess 15 in the manner of the retaining projection 84, so that the connecting element 12 can be rotated with respect to its axis of rotation D, but cannot be pulled out of the receptacle 283 along the axis of rotation D. Thus the adjustment element 280 is mounted so that it can rotate relative to the suction hose SL, for example, or the suction hose SL is mounted so that it can rotate relative to the adjustment element 280.

Furthermore, the adjustment element 280 is rotatably mounted relative to a connecting element 270, which is rotationally fixed with respect to the processing body 220 and the suction duct body 265. The connection element 270, for example, comprises a sleeve section 273, in which the suction duct body 265 is incorporated or in which it is inserted.

For example, the connection element 270 projects in front of a cover 243 and is preferably integrally connected to this cover, which in principle corresponds to the cover 43 and covers the processing body 220 on the front side. The cover 243 has a passage opening 244.

A bearing seat 278 for the adjustment element 280 is provided on connection element 270. The adjustment element 280 is rotatably mounted in the bearing seat 278. On the inner circumference of bearing seat 278, for example, there is a support projection 287 which engages in support seat 277 of adjustment element 280. The support projection 287 and the support seat 277 form a pull-out safety device or ensure that the adjustment element 280 can be rotated with respect to its axis of rotation D of the bearing seat 278, but cannot be pulled out of this bearing seat 278 along the axis of rotation D.

The adjustment element 280 is supported by front support projections 282 at the bottom of the bearing seat 278, in particular on a ring-shaped bearing surface 275. In the area of the bearing surface 275, additional notches 279 are provided, at least one notch 279, which are or are intended for locking with one or more locking projections 289. The at least one locking projection 289 protrudes in front of the support projections 282 and engages in the respective adjustment positions of the adjustment element 280 in the locking recess 279. The elasticity of the locking projection 289 is preferably increased by the fact that it has a cavity 289A into which an arc-shaped section 289B of the locking projection 289 can become distorted.

Symbols 98A and 98B and a further symbol not visible in the drawing are provided on the outer circumference of the sleeve-shaped adjustment element 280, for example its circumferential wall 291, which indicate the suction in relation to a processing surface section 28, 29 or 30.

In the interior of the adjustment element 280 there is an end wall 295, at which a flow-through opening 292 and optionally a flow-through opening 293 are provided. The flow-through opening 292 has a large surface area and extends over an angular segment which corresponds to the flow cross-section of a suction duct 245-247. If the flow-through opening 292 is located frontally in front of one of the suction ducts 245-247 or is aligned with it, a maximum flow cross-section is available for the processing surface section 28-30 assigned to the respective suction duct 245-247. However, if the smaller cross-section of the flow-through opening 293 is located in front of a respective suction duct 245-247, the flow cross-section is smaller, i.e. the suction capacity is reduced. If the end wall 295 completely or partially covers one of the suction ducts 245-247, the processing surface section 28, 29 or 30 assigned to the suction duct is not suctioned or is suctioned with reduced suction capacity. The adjustment element 280 thus influences the effective flow cross-section, which is available for a suction of a respective processing section 28, 29, 30.

The locking arrangement or the locking means with the locking projection 289 and the locking recess 279 is preferably designed in such a way that, in a respective locking position, the through-flow opening 292 is aligned with one of the suction ducts 245-247 in each case.

A cross-section of the flow opening 292 is equivalent to a cross-section of a suction duct 245, 246, 247.

A concept similar in principle to the adjustment device 260 has been selected for the 360 adjustment device, whereby the suction ducts 345, 346, 347 are separate tubes which pass through the processing body 320 parallel to the longitudinal axis L. The individual tubes can, for example, be integrally formed during the manufacturing process of the processing body 320, for example by foaming the base material 39 with a corresponding mould.

Instead of a single mask body 296, one or more mask bodies 396, 496 can be provided, e.g. disc-like or drum-like mask bodies. The mask bodies 396, 496 are, for example, mounted so as to be rotatable with respect to the suction ducts 345, 346, 347 around an axis of rotation not visible in the drawing and extending parallel to the longitudinal axis L between the suction ducts 345, 346, 347. The rotation axis, for example, corresponds to the rotation axis D already explained.

The mask body 396, for example, has a flow-through opening 392 and preferably another flow-through opening 393, which can be aligned with the suction ducts 345, 346, 347 by rotation about the aforementioned axis of rotation. Thus, the mask body 396 therefore forms an adjustment element 380.

Figure 13:
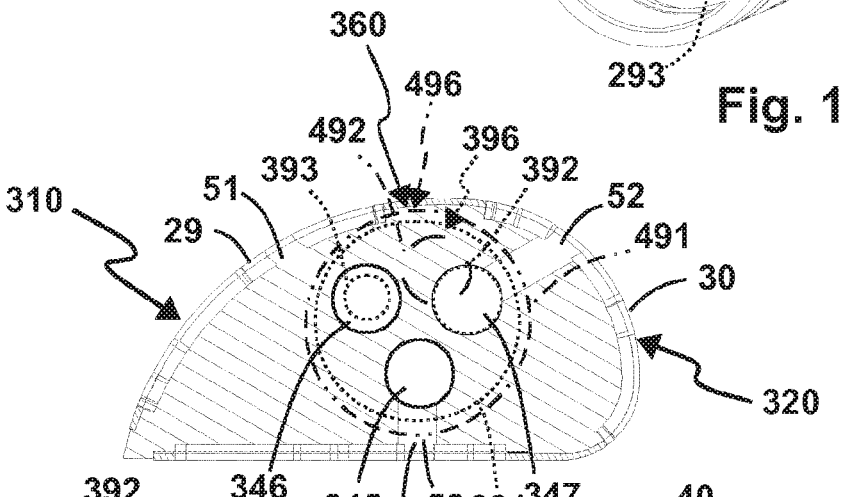
FIG. 13 an alternative processing body and an adjustment device with a functional principle similar to the adjustment device according to FIGS. 8-12, wherein the processing body has separate tubular suction ducts.
Figure 14:
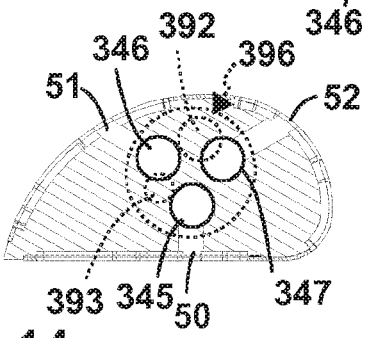
FIG. 14 shows the processing body and the adjustment device according to FIG. 13, but in a different setting position of the adjustment device.
Figure 15:
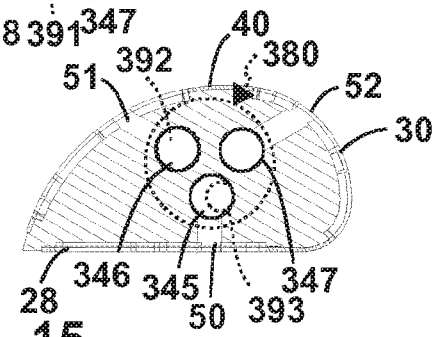
FIG. 15 the arrangement according to FIGS. 13, 14, with the adjustment device being further adjusted.

In FIG. 13, for example, the through-flow opening 392 is aligned with the suction duct 347, while the through-flow opening 393 is aligned with the suction duct 346, thus providing a smaller flow cross-section there. Accordingly, the processing surface section 30 is suctioned off with higher suction capacity than the processing surface section 29. FIG. 14 shows the mask body 396 rotated counter-clockwise so that the through-flow opening 392 is only partially in front of the suction duct 347, i.e. the suction capacity or the flow cross-section is reduced there. In FIG. 15, the through-flow opening 392 is aligned with the suction duct 346, so that maximum suction capacity is available at the processing surface section 29, while the suction at the processing surface section 30 is switched off, so to speak.

It can be seen that an infinitely variable adjustment of a suction capacity or a flow cross-section would be possible by means of the mask body 396 alone, namely that the mask body 396 or the adjustment element 380 can stand not only in such setting positions in which the through-flow opening 392 is aligned with one of the suction ducts 345, 346, 347, but also in intermediate positions in which the through-flow opening 392 only partially stands in front of one of these suction ducts and enables a reduced through-flow of the respective suction duct through the suction flow S.

The possibilities for adjustment the suction capacity on one or more of the processing surface sections 28, 29 or 30 can be improved by the additional mask body 496. This has, for example, a flow-through opening 492 which, by rotating the mask body 496 relative to the suction ducts 345, 346, 347 and relative to the flow-through openings 392 and optionally 393, makes it possible to adjust variable flow cross-sections between the suction connection 11 and the suction ducts 345, 346 and 347.

A processing body 420 (FIG. 16) is designed as a stepped body. For example, the processing body 420 has partial processing bodies 420A, 420B with different cross-sections. Both partial processing bodies 420A, 420B are arranged immediately adjacent to each other or adjacent to each other, wherein a step 418 is provided between the two partial processing bodies 420A, 420B. The partial processing bodies 420A, 420B can be made in one piece or from one piece.

Figure 16:
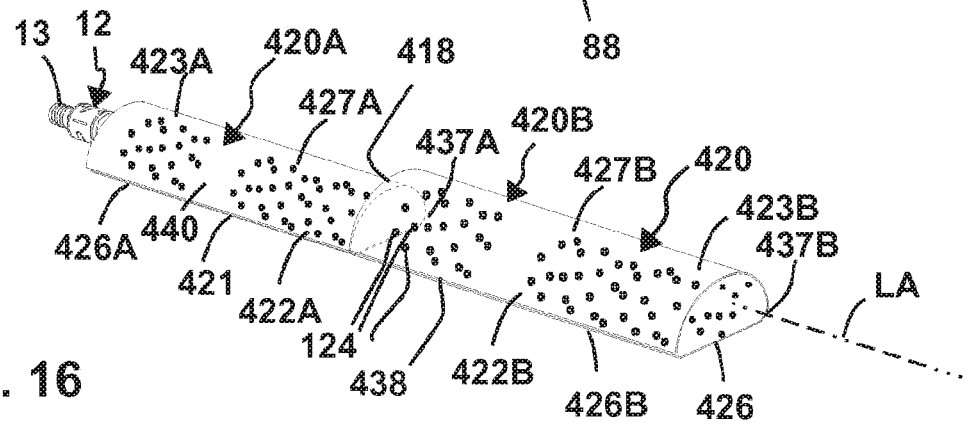
FIG. 16 shows a processing body designed as a stepped body.
Figure 8:
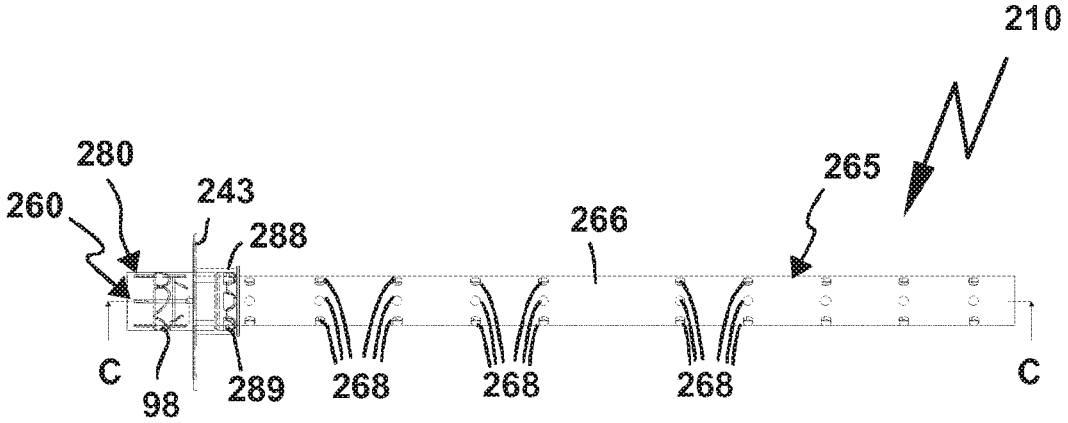
FIG. 8 a side view of an alternative adjustment device for adjustment a suction effect on the processing device according to the diagrams above.
Figure 9:
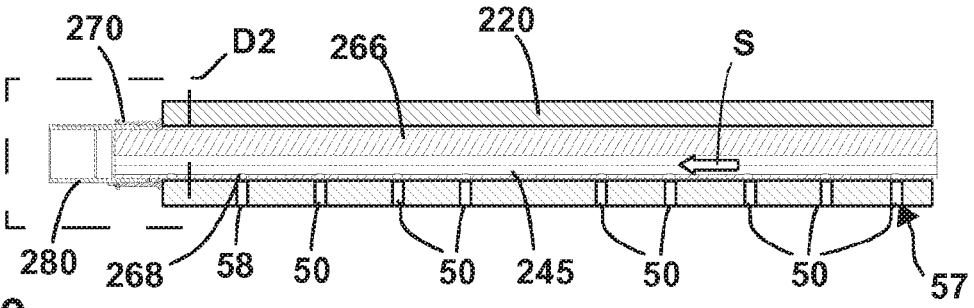
FIG. 9 a longitudinal section through the adjustment device as shown in FIG. 8, along a cut line C-C in FIG. 8.
Figure 10:
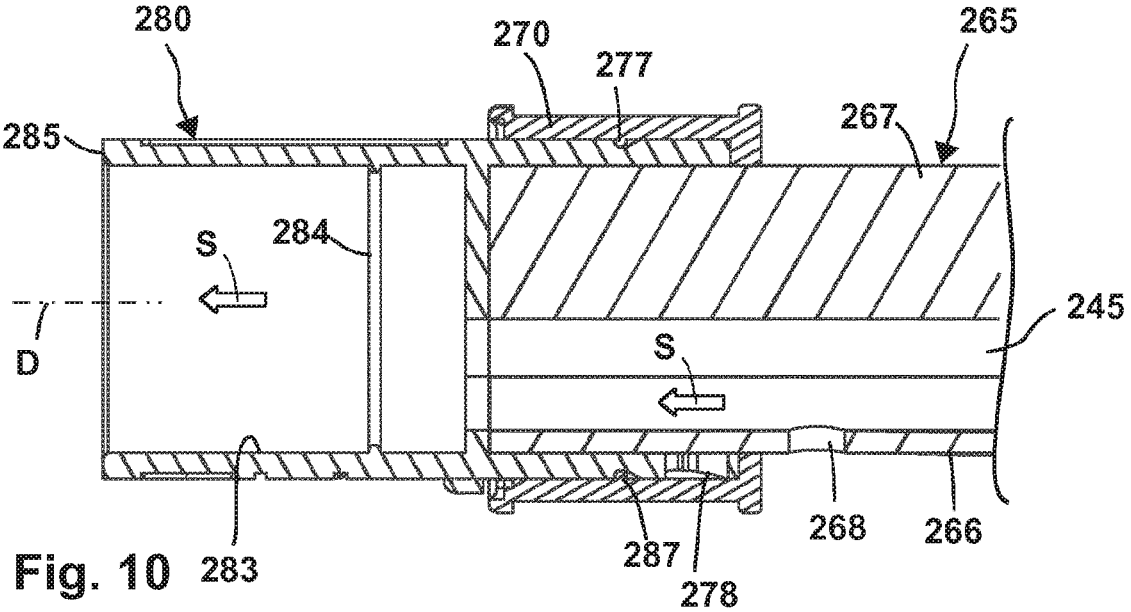
FIG. 10 a detail D2 from FIG. 9.
Figure 11:
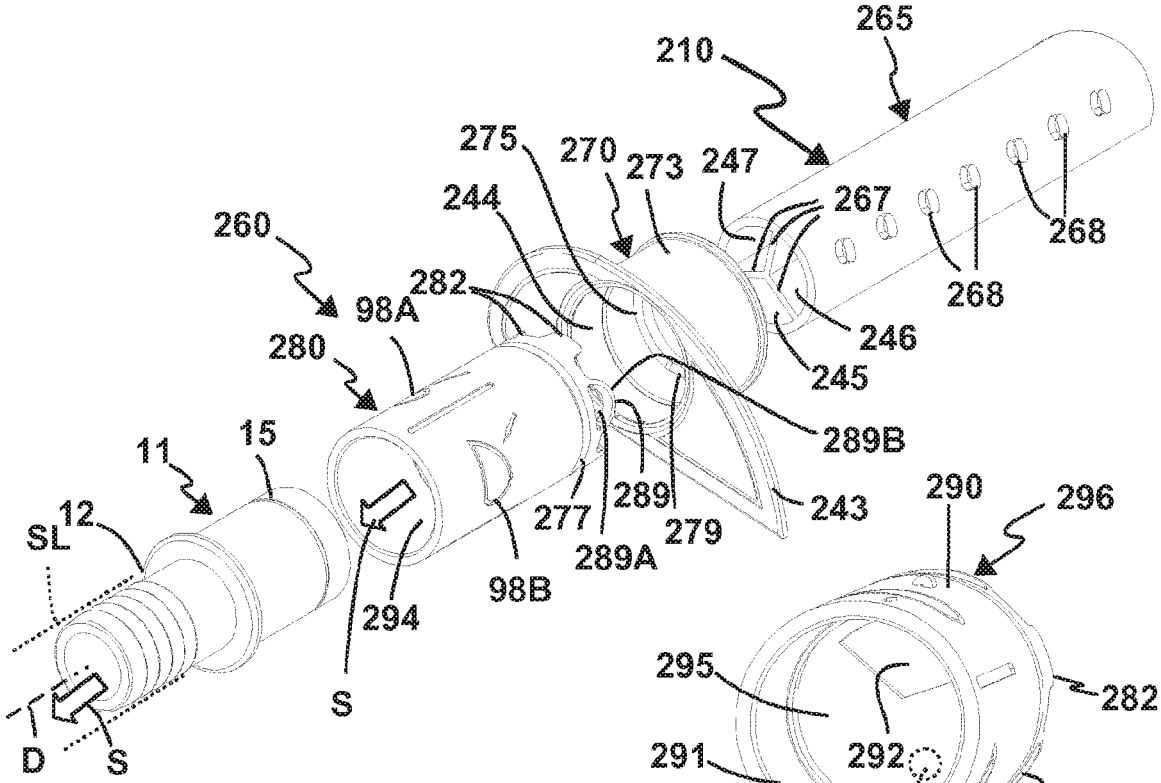
FIG. 11 an exploded view of the adjustment device according to FIGS. 8-10.
Figure 12:
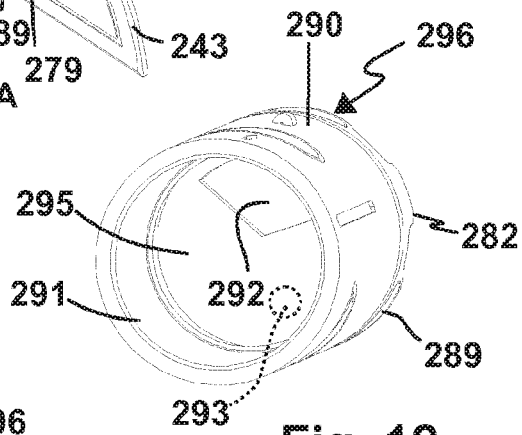
FIG. 12 a mask body of the adjustment device according to FIG. 11 in perspective oblique view.

The partial processing bodies 420A, 420B have the same cross-sectional geometry in the embodiment shown in FIG. 16, but different cross-sectional area dimensioning. As a result, curved portions 427A, 427B of the partial processing bodies 420A, 420B have the same basic geometric contours, but different radii.

The partial processing bodies 420A, 420B have curved portions 427A, 427B which geometrically correspond to the curved portion 27, and flat surface portions 426A, 426B which geometrically correspond to the flat surface portion 426.

In principle, it would be possible for the partial processing bodies 420A, 420B to be coaxial with respect to a longitudinal axis that passes through their respective cross sections in the middle. However, an embodiment has been selected in which the flat surface portions 426A, 426B of the partial processing bodies 420A, 420B merge with one another over their entire surface, i.e. merge with one another without a step, so that a continuous flat surface portion 426 is formed.

However, the stage 418 is provided between the curved portions 427A, 427B of the partial processing bodies 420A, 420B.

In addition, the configuration of processing body 420 is such that processing surfaces 422A, 422B of partial processing bodies 420A, 420B are aligned with each other at least in a transition region 438 corresponding to transition region 38 with respect to the flat surface portion 426, while stage 418 is formed between processing surfaces 423A, 423B, which in principle conform to the processing surfaces 23 already described, and between the transition regions 437A, 437B, which in principle correspond to transition region 37. Again, this offset or stage 418 can also be provided between the processing surfaces 422A, 422B if the partial processing bodies 420A, 420B are arranged differently relative to each other transversely to a longitudinal axis LA of the processing body 420 (not shown).

A suction system is preferred for the processing body 420, i.e. for example the connection element 12 with the connection section 13 is arranged on the processing body 420, especially on the partial processing body 420A with a smaller cross-section. However, it would also be possible to provide such a suction connection on the other partial processing body 420B with a larger cross-section.

The abrasive material 124, for example a grit, a granular structure, a knitted fabric or the like, can be arranged directly on the processing body 420, in particular the processing surfaces 423A and/or 423B and/or 422A and/or 422B.

It is also possible that the processing body 420 has, for example, a holding means 480 comparable to the holding means 40 in the region of the processing surfaces 423A and/or 423B and/or 422A and/or 422B to which an abrasive or polishing agent, for example an abrasive sheet, polishing material, polishing knitted fabric or polishing cloth or the like, can be detachably fastened.

It is possible that different surface textures are provided on the processing surfaces 423A, 423B, 422A, 422B, e.g. a holding agent on one of the processing surfaces, a polishing material on another and a polishing knitted fabric on another processing surface.

The invention claimed is:

1. A surface processing device, with a processing body which has at least one processing surface for grinding or polishing a workpiece surface, wherein inlet openings for suctioning off dust-laden dust air are arranged on the at least one processing surface, said plurality of inlet openings being flow-connected via a duct arrangement to a suction connection to which a suction device can be connected, and wherein the processing device further comprises an adjustment device for adjustment of a suction flow of the dust-laden dust air, with which the inlet openings of a first processing surface section of the at least one processing surface and the inlet openings of at least one second processing surface section of the at least one processing surface are flow-connected to the suction connection, so that a suction effect on the first processing surface section and the at least one second processing surface section can be set or switched off, and wherein the first processing surface section and the at least one second processing surface section are arranged on mutually angular sides of an outer circumference of the processing body, and wherein the adjustment device has a manually operable adjustment element for adjusting the suction flow, and wherein the adjustment element is connected to a mask body, wherein the mask body is arranged between the inlet openings of the processing surface sections and the suction connection, the mask body having a passage section and at least one reducing section, the passage section having at least one passage opening and the at least one reducing section being adapted to reduce the suction flow between the inlet openings of at least one processing surface section and the suction connection as compared to the passage section, wherein the mask body is rotatably mounted within the processing body for positioning the passage section or the at least one reducing section with respect to the processing body.

2. The surface processing device according to claim 1, wherein the adjustment device is designed to reduce the suction flow between the suction connection and the inlet openings of the first processing surface section in favor of an increase in the suction flow between the suction connection and the inlet openings of the at least one second processing surface section.

3. The surface processing device according to claim 1, wherein the adjustment device is designed such that either the inlet openings of the first processing surface section or the inlet openings of the at least one second processing surface section are connected to the suction connection for switching a flow connection between the suction connection and the inlet openings of the first processing surface section and the inflow openings of the at least one second processing surface section.

4. The surface processing device according to claim 1, further comprising fixing means for fixing the adjustment device in at least one setting position in which the suction connection is flow-connected to only one of the processing surfaces.

5. The surface processing device according to claim 1, wherein the mask body permits the suction flow between the inlet openings of a respective processing surface section and the suction connection only at the passage section.

6. The surface processing device according to claim 1, wherein at least one central duct extends along a longitudinal axis of the processing body and is flow-connected to the suction connection and to the inlet openings of at least one of the first processing surface section or the at least one second processing surface section by means of transverse ducts.

7. The surface processing device according to claim 1, wherein a respective suction duct is provided for each processing surface, wherein each suction duct extends along the longitudinal axis of the processing body and is flow-connected to the inlet openings of the respective processing surface section.

8. The surface processing device according to claim 1, wherein a sleeve-shaped connecting element of the suction connection is mounted rotatably with respect to the processing body for connecting a suction hose, the processing body and the suction hose being rotatable relative to one another without an adjustment of the adjustment device.

9. The surface processing device according to claim 1, wherein an inlet channel arrangement, which is open laterally with respect to the processing surface, is arranged on the at least one processing surface and is flow-connected to the suction connection by means of at least one of the inlet openings.

10. The surface processing device according to claim 1, wherein the processing body has a flat surface portion with a flat processing surface for processing flat workpiece surfaces and at least one curved portion with a curved processing surface for processing curved workpiece surfaces.

11. The surface processing device according to claim 10, wherein the curved portion adjoins transverse end regions of the flat surface portion and extends over a side of the processing body opposite to the flat surface portion, wherein the curved portion has a plurality of continuously merging curvature sections with mutually different radii of curvature and, wherein the curved portion does not extend beyond the flat processing surface of the flat surface portion.

12. A surface processing device with a processing body which has at least one processing surface for grinding or polishing a workpiece surface, wherein inlet openings for suctioning off dust-laden dust air are arranged on the at least one processing surface, said plurality of inlet openings being flow-connected via a duct arrangement to a suction connection to which a suction device can be connected, and wherein the processing device further comprises an adjustment device for adjustment of a suction flow of the dust-laden dust air, with which the inlet openings of a first processing surface section of the at least one processing surface and the inlet openings of at least one second processing surface section of the at least one processing surface are flow-connected to the suction connection, so that a suction effect on the first processing surface section and the at least one second processing surface section can be set or switched off, and wherein the first processing surface section and the at least one second processing surface section are arranged on mutually angular sides of an outer circumference of the processing body, and wherein at least one central duct extends along a longitudinal axis of the processing body and is flow-connected to the suction connection and to the inlet openings of at least one of the first processing surface section or the at least one second processing surface section by means of transverse ducts, and wherein an air guiding body is mounted rotatably within the central duct about an axis extending along the longitudinal axis, wherein the air guiding body has at least one through-flow opening on its outer circumference, the at least one through-flow opening being flow-connected to a flow channel defined by an interior of the air guiding body, the flow channel extending along the longitudinal axis and is flow-connected to the suction connection, so that, by rotating the air guiding body in the central duct, the at least one through-flow opening of the air guiding body is displaced relative to the inlet openings and to at least one passage opening of the central duct communicating with the inlet openings of at least one processing surface section for changing the effective flow of the suction flow between the inlet openings relative to the suction connection.

13. The surface processing device according to claim 12, wherein the adjustment device has a manually operable adjustment element for adjusting the suction flow.

14. The surface processing device according to claim 13, wherein the adjustment element is connected to a mask body, wherein the mask body is arranged between the inlet openings of the processing surface sections and the suction connection, the mask body having a passage section and at least one reducing section, the passage section having at least one passage opening and the at least one reducing section being adapted to reduce the suction flow between the inlet openings of at least one processing surface section and the suction connection as compared to the passage section, wherein the mask body is rotatably mounted within the processing body for positioning the passage section or the at least one reducing section with respect to the processing body.

15. The surface processing device according to claim 12, wherein the air guiding body has a first angular segment region and a second angular segment region of its outer circumference, the at least one through-flow opening being provided on the first angular segment region and no through-flow openings or through-flow openings with a smaller flow cross-section than the at least one through-flow opening provided on the first angular segment region being provided on the second angular segment region, wherein the through-flow openings are flow-connected to the central duct, and wherein by rotating the air guiding body, the first angular segment region and the second angular segment region are displaced relative to the inlet openings of the first processing surface section or the at least one second processing surface section for adjustment of the effective flow of the suction flow between the suction connection and the respective processing surface.

16. The surface processing device according to claim 12, wherein the air guiding body has sealing contours on its outer circumference which extend in the longitudinal direction and delimit at least one angular segment region or wherein the air guiding body has sealing contours, which extend in the circumferential direction and delimit a longitudinal region and, wherein the sealing contours bear against an inner circumference of the central duct.

17. A surface processing device with a processing body which has at least one processing surface for grinding or polishing a workpiece surface, wherein inlet openings for suctioning off dust-laden dust air are arranged on the at least one processing surface, said plurality of inlet openings being flow-connected via a duct arrangement to a suction connection to which a suction device can be connected, and wherein the processing device further comprises an adjustment device for adjustment of a suction flow of the dust-laden dust air, with which the inlet openings of a first processing surface section of the at least one processing surface and the inlet openings of at least one second processing surface section of the at least one processing surface are flow-connected to the suction connection, so that a suction effect on the first processing surface section and the at least one second processing surface section can be set or switched off, and wherein the first processing surface section and the at least one second processing surface section are arranged on mutually angular sides of an outer circumference of the processing body, and wherein a respective suction duct is provided for each processing surface, wherein each suction duct extends along the longitudinal axis of the processing body and is flow-connected to the inlet openings of the respective processing surface section, and wherein the adjustment device has a manually operable adjustment element for adjusting the suction flow, and wherein the adjustment element is connected to a mask body, wherein the mask body is arranged between the inlet openings of the processing surface sections and the suction connection, the mask body having a passage section and at least one reducing section, the passage section having at least one passage opening and the at least one reducing section having a closure surface for closing a flow connection between the inlet openings of at least one processing surface section and the suction connection or has a smaller effective flow cross-section than the passage section, wherein the mask body for positioning the passage section or the at least one reducing section between the suction connection and the inlet openings of a respective processing surface section is mounted rotatably, with respect to the processing body by means of a rotary bearing, for the purpose of positioning the passage section or the at least one reducing section, and wherein the mask body is arranged between the suction connection and the suction ducts, wherein the mask body is mounted movably by means of the bearing between a respective suction duct and the suction connection for positioning the passage section and the at least one reducing section.

18. A surface processing device, with a processing body which has at least one processing surface for grinding or polishing a workpiece surface, wherein inlet openings for suctioning off dust-laden dust air are arranged on the at least one processing surface, said plurality of inlet openings being flow-connected via a duct arrangement to a suction connection to which a suction device can be connected, and wherein the processing device further comprises an adjustment device for adjustment of a suction flow of the dust-laden dust air with which the inlet openings of a first processing surface section of the at least one processing surface and the inlet openings of at least one second processing surface section of the at least one processing surface are flow-connected to the suction connection, so that a suction effect on the first processing surface section and the at least one second processing surface section can be set or switched off, and wherein the adjustment device comprises:

a manually operable adjustment element for adjusting the suction flow; and a mask body connected to the adjustment element, wherein the mask body is arranged between the inlet openings of the processing surface sections and the suction connection, the mask body having a passage section and at least one reducing section, the passage section having at least one passage opening and the at least one reducing section being adapted to reduce the suction flow between the inlet openings of at least one processing surface section and the suction connection as compared to the passage section, wherein the mask body is rotatably mounted within the processing body for positioning the passage section or the at least one reducing section with respect to the processing body.

19. The surface processing device according to claim 18, wherein the first processing surface section and the at least one second processing surface section are arranged on mutually angular sides of an outer circumference of the processing body or wherein the first processing surface section and the at least one second processing surface section are arranged on opposite sides of the processing body.

* * * * *